United States Patent [19]

Peterson

[11] Patent Number: 4,683,734

[45] Date of Patent: Aug. 4, 1987

[54] LOCKED COVER FOR AIR CONDITION RESPONSIVE CONTROLLER

[76] Inventor: Carroll T. Peterson, 3123 Hayes St. NE., Minneapolis, Minn. 55418

[21] Appl. No.: 876,176

[22] Filed: Jun. 19, 1986

[51] Int. Cl.[4] ..... B65D 55/14

[52] U.S. Cl. ..... 70/163; 70/167; 70/171; 174/17 VA; 109/52

[58] Field of Search ..... 70/163, 164, 165, 166, 70/167, 168, 169, 170, 171, 172, 173; 236/DIG. 9; 337/360, 380; 174/67, 17 VA, 50; 200/306, 43.16, 43.22; 361/383; 324/110; 109/50, 52; 292/DIG. 63; D10/60

[56] References Cited

U.S. PATENT DOCUMENTS

| | | | |
|---|---|---|---|
| 2,152,497 | 3/1939 | Petermichl | 200/306 |
| 3,771,387 | 11/1973 | Lewis | 337/380 |
| 3,900,700 | 8/1975 | Gaudet | 174/17 VA |
| 4,063,110 | 12/1977 | Glick | 174/67 |
| 4,107,959 | 8/1978 | Skarzynski et al. | 70/164 |
| 4,584,856 | 4/1986 | Petersdorff et al. | 70/167 |

*Primary Examiner*—Cornelius J. Husar
*Assistant Examiner*—Anthony Knight
*Attorney, Agent, or Firm*—Kinney & Lange

[57] ABSTRACT

A locked cover for surrounding an air condition responsive controller such as a thermostat to prevent the setting from being altered by people unauthorized to do so. This is accomplished by baffles which are opposite the openings in the cover to prevent tools from being inserted through these openings to adjust the control. The baffles have openings through them to permit air to flow to the controller. In one form, the baffles are rigidly secured in position in an otherwise existing type of guard cover. In another form of the invention, there are a plurality of interlocking pieces which can be fitted together and placed within an existing cover to prevent access to the adjustment for the controller. In still another version, the guard cover is modified so that the openings for admission of air are not adjacent the controller, but are spaced outwardly therefrom with the openings through the baffles adjacent the controller.

9 Claims, 7 Drawing Figures

LOCKED COVER FOR AIR CONDITION RESPONSIVE CONTROLLER

BACKGROUND OF THE INVENTION

1. Field of the Invention

The present invention pertains to locked covers for surrounding air condition responsive controllers to prevent the setting from being altered by those unauthorized to do so.

In buildings having a number of different occupants, it is desirable to provide some means for preventing the air condition responsive controllers, such as thermostats, from being tampered with. The building management often sets the controller at a temperature which the management considers is desirable and comfortable for a majority of the occupants of the building. Often, however, certain of the occupants will feel that the condition for which the controller is set is not a comfortable condition and attempts will be made to change the setting. For this reason, it is quite customary, in connection with such buildings, to provide a guard around the controllers, such as a thermostat, which is locked in position. Such a guard, of necessity, has to have openings through which the air can pass to get to the controller. Ingenious people will often find tools to insert through these openings and adjust the setting of the controller. This defeats the purpose of the thermostat guard and may lead to a temperature which, while comfortable to the person making the unauthorized adjustment, is uncomfortable to other people or which wastes heat or cooling.

SUMMARY OF THE INVENTION

The present invention is concerned with a guard for an air condition responsive controller in which means are provided for preventing a tool from being used to make unauthorized adjustment of the controller. This is accomplished by providing a baffle between the openings in the guard and the controller, the baffle being spaced from the openings in the guard sufficiently to permit a circulation of air around the baffle to the controller so as not to interfere with the response of the controller to changes in the condition of the air. The baffle may be rigidly secured within the guard housing. For example, it may be molded with the housing, where the housing is molded.

The baffle members may, however, be separate interlocking members which can be inserted into an existing guard housing and be retained in position.

While the present invention may be employed as a modification of an existing housing in which the openings through the guard are closer to the wall and hence to the thermostat or other controller, an even more satisfactory arrangement is one in which the openings through the guard are in front of the controller and the openings through the baffle members are to the rear so that the air can freely flow through the openings in the baffle members directly to the air condition responsive controller.

Further features of the invention will be apparent from the consideration of the accompanying specification and drawing.

DETAILED DESCRIPTION OF THE PREFERRED EMBODIMENTS

Figure 1:
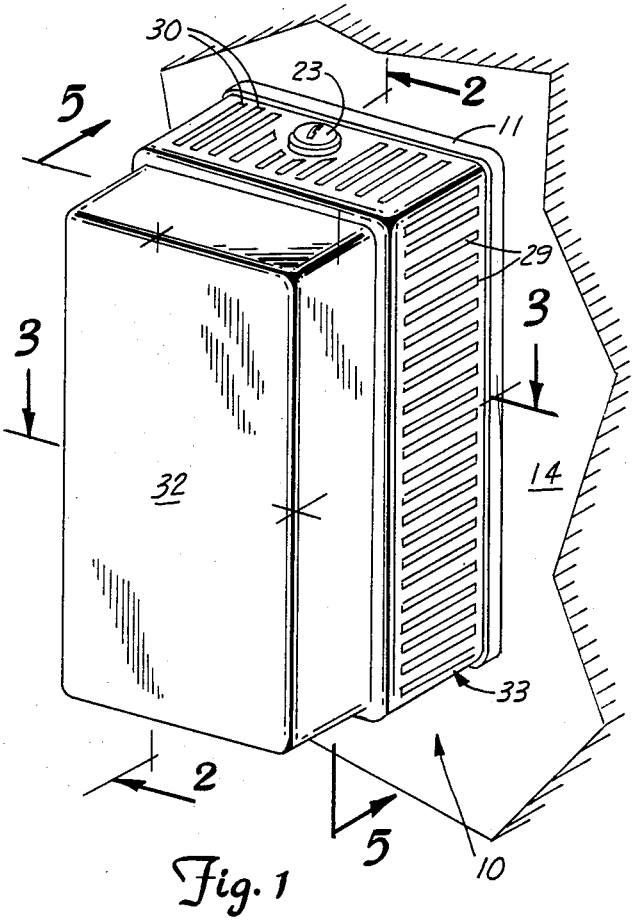
FIG. 1 is a perspective view of a guard unit for an air condition responsive controller.

Referring first to FIG. 1, the thermostat guard or cover is generally indicated by the reference numeral 10. It is secured to a plate member 11 which in turn is fastened to a wall 14. Located within the guard 10 is an air condition responsive controller 16 which, in the present example, is shown as a thermostat. The thermostat 16 has a cover containing a number of openings 17 through which air may flow to the temperature sensitive element within the thermostat. A suitable temperature adjusting device 18 is located at any convenient spot on the thermostat 16. The thermostat has conductors 19 secured to the switching portions of the controller 16. These conductors extend through a hole in the wall 14 and lead to control devices for the condition changing device, such as a furnace, an air conditioning compressor, or a humidifying apparatus.

The cover 10 is locked in place by being fastened to the rear plate 11. At the top of the plate 11 is a projecting housing 20, best shown in FIG. 4 in connection with a modification of the idea. The housing 20 has a slot 21 which cooperates with an arm 22 rotated by a shaft 23. The arm 22 is movable between a position in which it is in engagement with the slot 21 and a position in which it is clear of the slot. In the latter position, the housing 20 can be readily withdrawn. It is to be understood that while I have shown a member with a screw head for rotating the arm 22 into and out of locking engagement with the housing 20, in actual practice, a lock would control the rotation of the shaft 23 and this shaft could be rotated only by someone who possessed a key. The housing 20 is retained at its lower end by a tongue 27 which extends into a slot in an ear 26 extending forwardly from the plate 11. Thus, upon the arm 22 being rotated out of engagement with the slot 21 of the housing 20, the upper portion of the housing can be tilted outwardly to withdraw the tongue 27 from the slot in the ear 26.

The cover 10 is provided with a plurality of slots 29 in the side walls and 30 on the top wall. As shown in section in FIG. 2, there are also slots 31 in the bottom wall of the cover. These slots are provided for the purpose of enabling air to circulate through the locked guard into air condition exchange relation with the controller 16. Thus, air may enter the slots 29 and 31, and pass through the slots 17 of the thermostat or other controller to the air condition responsive element, such as a bi-metal in the case of a thermostat.

The device as described so far is very similar to those presently on the market. One such is the TG500A thermostat guard marketed by Honeywell, Inc. As has been pointed out, the drawback of the arrangement as described so far is that a person may insert a tool through the slots 29, for example, and adjust the setting device 18 for adjusting the control point of the controller 16. The present device is provided with further features to prevent this, as will be presently described.

Figure 2:
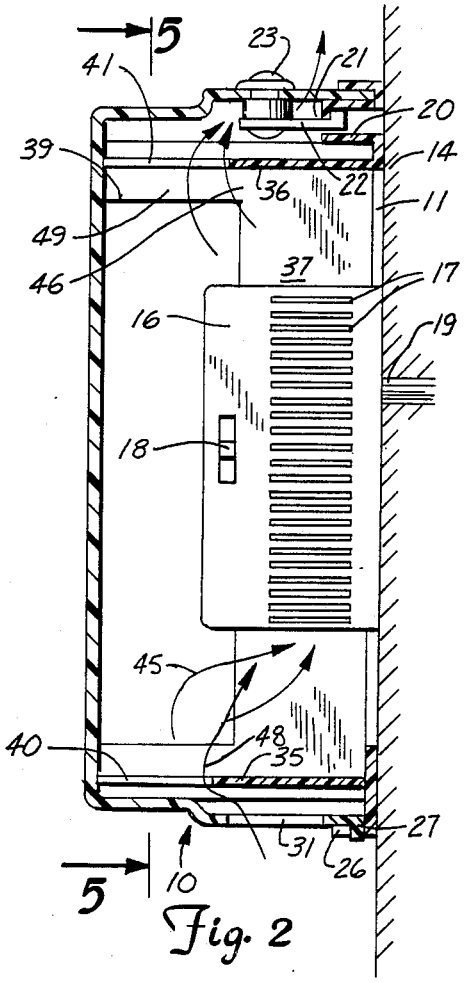
FIG. 2 is a vertical sectional view taken along the line 2—2 of FIG. 1.
Figure 3:
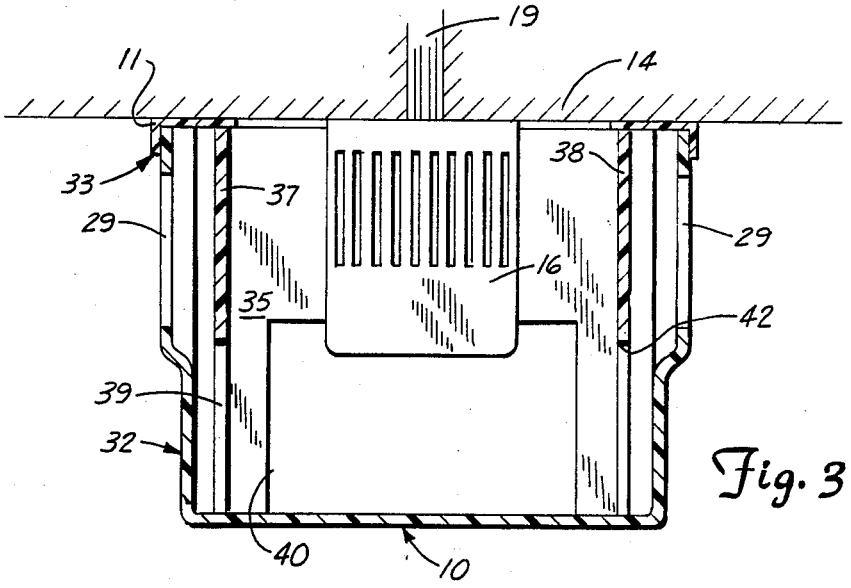
FIG. 3 is a horizontal sectional view taken along the line 3—3 of FIG. 1.

As will be noted from FIGS. 2 and 3, the housing of my invention is provided with lower and upper baffle plates 35 and 36, and side baffle plates 37 and 38. Each of these baffle plates is substantially imperforate over the portion adjacent the controller 16, but is provided with a cut-away portion or opening to permit air to circulate to the controller. For example, referring to the side baffle 37, it will be noted from FIG. 2 that this has a cut-away portion 39 which extends substantially the full height of the baffle 37. Similarly, the lower baffle 35 has a cut-away portion 40 through which air can circulate. The upper baffle plate 36 has a cut-away portion 41 and the baffle plate 38 has a cut-away portion 42, as shown in FIG. 3. It is to be understood that the cut-away portion 42 is of the same general configuration as the cut-away portion 39 of baffle 37. Similarly, the cut-away portion of baffle 36 is of the same configuration as the cut-away portion 40 of baffle 35. These baffles may be secured in any suitable manner to the interior of the housing. They may, for example, be molded with the housing or they may be cemented to the interior of the housing by a suitable adhesive. It will be noted that in each case, the baffle is spaced inwardly from the adjacent wall of the guard cover 10 to provide for circulation of air. The path of air flow through the lower and upper openings is generally indicated by the flow lines 48 and 46. It will be noted that air can enter upwardly through the slots 31, as indicated by flow line 48, and pass around the baffle 35 through the cut-away portion 40 into air exchange relation with the controller 16. The air, after leaving the top of the controller 16, will pass through the cutaway portion 41 of the baffle 36, as indicated by the flow line 46. After passing through the opening 41, the air then passes through the openings 30 in the top of the cover 10. Air can also enter through the side openings or slots 29 and through the cut-away portions 30 and 42 of baffles 37 and 38. This is shown by a flow line 45 in connection with baffle 37. The air passes through the cut-away portion 41 of baffle 36, as indicated by flow line 49, and out through the upper openings. The same action takes place in connection with baffle 38.

It will be noted that despite the fact that air can circulate into heat exchange relationship with the thermostat 16, it is impossible for someone to operate the adjustment device 18 for the thermostat. If it is attempted to insert a tool through the slots 29, 30 or 31, the tool will encounter the adjacent baffle member. Thus, if it is attempted to insert a tool through the lower slot 31, it will engage the baffle 35 and it cannot reach the adjusting device 18. Thus, the device as described serves the function of guarding the thermostat 16 and very effectively prevents unauthorized adjustment of the thermostat or other condition controller.

The cover 10, as will be noted from the drawing, has an outward portion 32 which is of smaller over dimension than an inner portion 33 in which the slots are disposed, as best shown in FIG. 3. One reason for this is to permit greater room for circulation of air adjacent the slots 29, 30, and 31.

MODIFICATION OF FIG. 4

Figure 4:
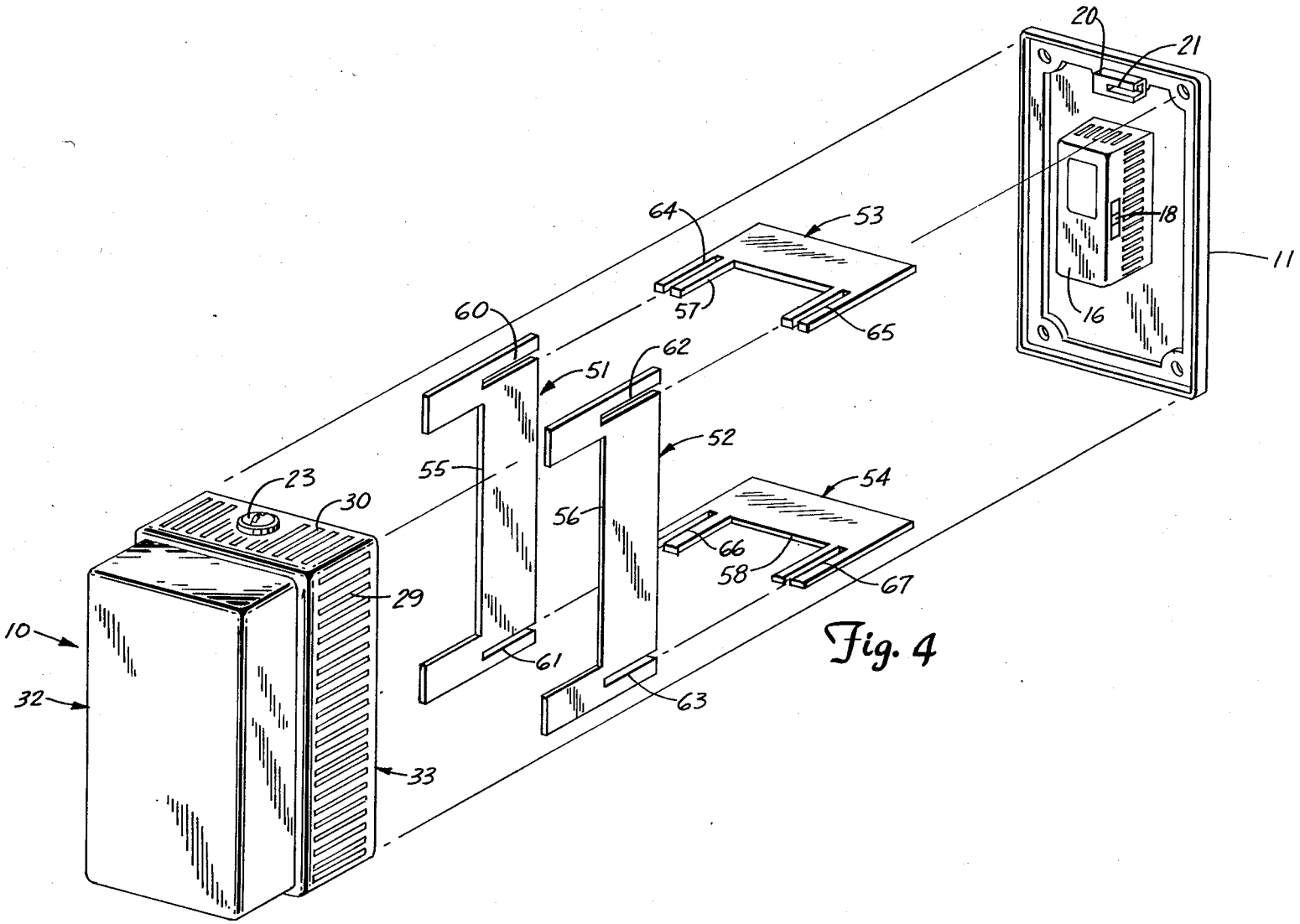
FIG. 4 is an exploded view of a modified form of my invention.

The arrangement of FIG. 4 is very similar to that of FIGS. 1 through 3, with exception of the baffle members. The cover 10 is exactly the same as the cover of FIGS. 1 through 3, with the exception of the baffles. The plate 11 is similarly the same and the manner in which the cover 10 is secured to the plate 11 is the same as in FIGS. 1 through 3.

With the arrangement of FIG. 4, there are four separate baffle members 51, 52, 53 and 54. Baffle members 51 and 52 correspond in function to the side baffle member 37 and 38 of FIG. 3, whereas baffle members 53 and 54 are the top and bottom baffle members and correspond to baffle members 36 and 35 of FIG. 2. Baffle members 51 and 52 have an overall height equal to the interior height of the narrow portion 32 of the cover 10. Baffle members 53 and 54 have an overall width equal to the interior width of the narrow portion 32 of cover 10. The baffle member 51 is provided with slots 60 and 61 of a width equal to the thickness of the material of baffle members 53 and 54. Similarly, baffle member 52 is provided with slots 62 and 63, again equal to the thickness of the material of baffle numbers 53 and 54. Baffle members 53 and 54 are provided with slots 64 and 65, and 66 and 67, respectively. Again, these slots are of a width corresponding to the thickness of baffle members 51 and 52. The baffle members 51 and 52 have cut-away portions or openings 55 and 56, and the baffle members 53 and 54 have cut-away portions 57 and 58.

Figure 5:
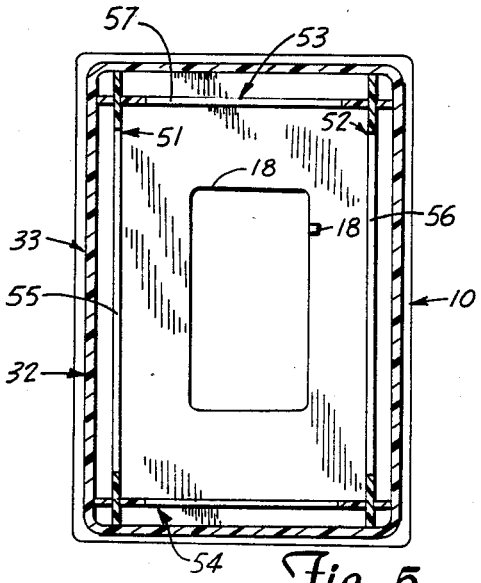
FIG. 5 is a vertical sectional view of the modification of FIG. 4.

It will be readily apparent that it is possible to interlock the baffle members 51, 52, 53 and 54 by sliding baffle members 53 and 54 through the slots 60, 61, 62 and 63 until the outer ends of the baffle members 53 and 54 are aligned with the outer ends of baffle members 51 and 52. When they are thus assembled and moved within the narrow portion 32 of the cover 10, they will assume the position shown in section in FIG. 5. It will be noted that inasmuch as the vertical length of members 51 and 52 corresponds to the vertical length of the narrow portion 32 of the cover 10, and the horizontal width of the members 53 and 54 corresponds to the horizontal width of the narrow portion of the cover 10, the baffle members will be securely retained in place within the narrow portion 32 of cover 10. The baffle members 51, 52, 53 and 54 have an overall depth substantially equal to the depth of the cover 10. Thus, the portions of these baffle members which are not cut away will be opposite to the slots 29 and 30 of the cover 10. Thus, it will again be impossible for a person to push a tool through the slots 29 and 30 to actuate the adjusting device 18 for the controller 16. The advantage of the arrangement of FIG. 4 is that all it is necessary to provide are the four members 51, 52, 53 and 54 which can readily be inserted into the existing cover 10 and will remain in place because of the engagement of the end portions of these members with the interior wall of the narrow portion 32 of the cover 10. In the arrangment of FIG. 4, it is possible to readily modify the existing thermostat cover to prevent tampering with the adjustment without any major alteration. All that is necessary to do is to remove the cover 10 from the base plate 11 and then to assemble the four members 51, 52, 53 and 54, and insert them into the narrow portion 32 of the cover 10. This can be quickly done. The members 51 through 54 can obviously be packed readily in a very small package.

MODIFICATION OF FIGS. 6 AND 7

Figure 6:
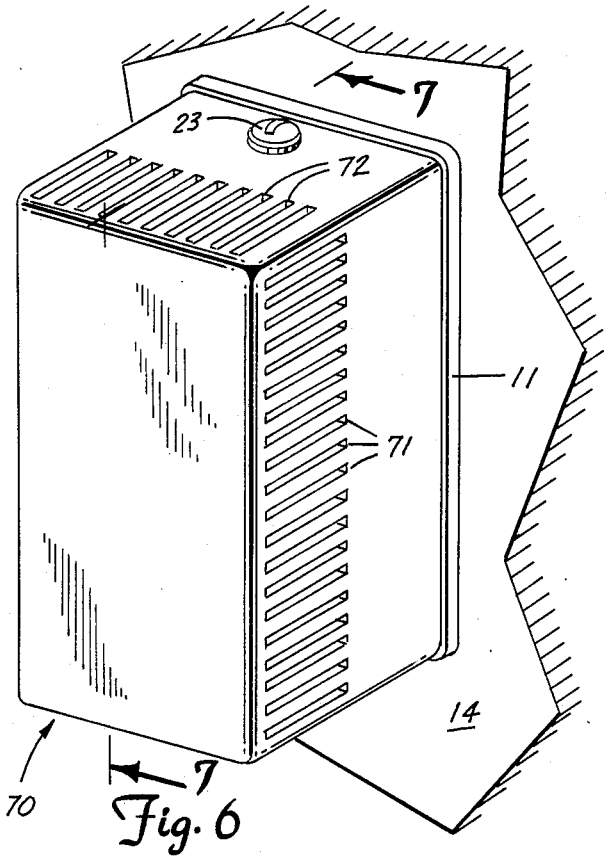
FIG. 6 is a perspective view of a still further modification of my invention.
Figure 7:
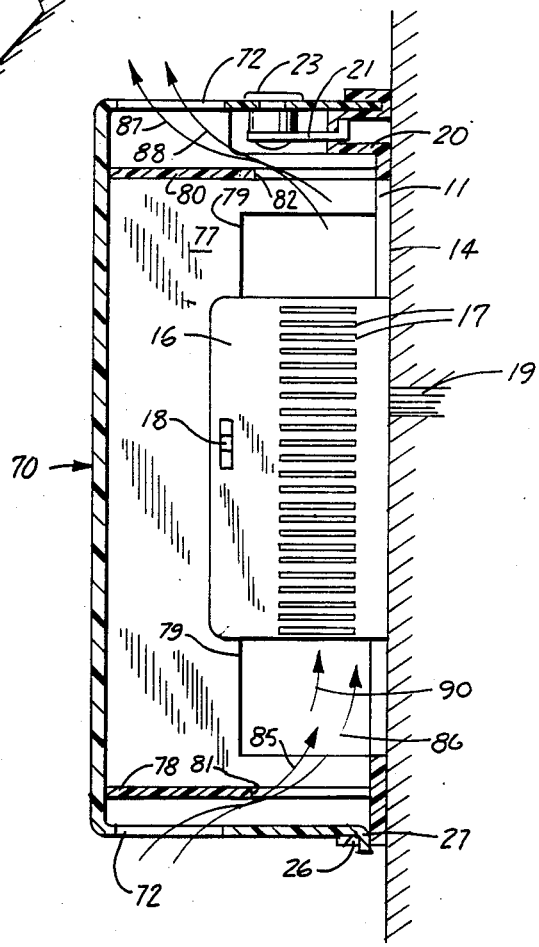
FIG. 7 is a sectional view taken along the lines 7—7 of FIG. 6.

The modification of FIGS. 6 and 7 is similar to that of FIGS. 1 through 3, with the principal exception that in the arrangement of FIGS. 6 and 7, the slots in the guard cover are in the outer part of the cover and the slots in the baffle are adjacent the thermostat. This produces an easier flow of air than with the arrangements of FIGS. 1 through 3. It does, however, involve a change in the guard cover.

Referring specifically to FIGS. 6 and 7, the overall guard cover is indicated by the reference numeral 70. In order to facilitate a comparison of these figures with those of FIGS. 1 through 3, the same reference characters have been applied to identical elements. Thus, a thermostat 16 is fastened to a wall 14. The guard cover 70 is secured to a plate 11, fastened to the wall 14, by means of a key operated arm 22 which engages with a slot in an outwardly projecting housing 20. The arm 22, as in FIGS. 1 and 2, is operated by a shaft actuated by a slotted head 23. The cover at its lower end has a tongue 27 which fits into a slot in the flange 26 projecting outwardly from the plate 11.

Referring to FIG. 6, it will be noted that there are slots 71 in the side walls of cover 70, and slots 72 in the top and bottom walls. Only the slots in the top and one side wall are shown. As has been mentioned previously, these slots are in the outer portion of the cover, away from the thermostat. Four baffle members are secured within the cover 70, just as in the species of FIGS. 1 through 3. The difference is that in this case the openings in the baffles are adjacent the thermostat. Referring specifically to FIG. 7, it will be noted that there are side baffles 77 and bottom and top baffles 78 and 89, only one of the side baffles being shown. It will be understood that there is an equivalent baffle on the other side of the thermostat.

It will be noted that the side baffle 77 has a cutaway portion 79. The bottom baffle 78 has a cutaway portion 81 and the top baffle 80 has a cutaway portion 92. These cutaway portions, which allow air to flow through the baffle member, are adjacent the thermostat 16 so that air passing through these cutaway portions can readily pass through and around the thermostat.

The action of the air flow is best shown in FIG. 7 in which there are lower flow lines 85 and 86 for indicating the vertical air flow through the loewr openings 72, past the thermostat and out through the upper openings 72, the flow through openings 72 being indicated by flow lines 87 and 88. The flow line 90 indicates the air coming through the cutaway portion 79 from the side through openings 71 in the thermostat cover. This air likewise flows upwardly around the thermostat and may pass out either along the flow lines indicated by reference characters 87 or 88, or out through the opening provided by cutaway portions 79 and then through side openings 71 in the thermostat guard.

The arrangement of FIGS. 6 and 7 has the same advantage of preventing a tool from being inserted through the openings to operate the control 18. In this case, the portion of the guard cover 70 that is adjacent the thermostat is imperforate so that no tool can be inserted. Any tools inserted through the slots 71 or 72 would encounter the imperforate portions of the baffles 77, 78 and 80 so that the tool could not reach the control 18.

The arrangment of FIGS. 6 and 7 has the advantage that a less resistant flow path is provided for the air flowing through the openings in the cover and around the thermostat. As will be readily visible from a comparison of the flow lines in FIGS. 2 and 7, the air entering openings 72 or 71 has an easier flow path. In the arrangement of FIG. 2, it is necessary for the air to flow first in one direction and then the other. In the arrangement of FIG. 7, the air flow in always generally in the same direction.

The arrangement of FIGS. 6 and 7, while having the advantage of providing a much better air flow through the air guard, does at the same time protect against a tool being inserted through the openings in the guard to operate the control for the thermostat or other controller.

CONCLUSION

While I have shown certain specific embodiments of my invention for purposes of illustration, it is to be understood that the invention is limited solely by the scope of the appended claims.

What is claimed is:

1. A locked cover for surrounding a wall mounted air condition responsive controller having means for adjusting the control setting thereof, said cover preventing unauthorized adjustment of the setting of said controller;

a member designed to be secured to a wall in such a manner as to be positioned outwardly from the periphery of that portion of an air condition responsive controller which is secured to the wall;

a cover shaped to be secured to the member and having means for locking the cover to the member, the cover having a front wall and side walls and apertures through portions of the side walls for allowing air to enter the cover and circulate in air condition exchange relationship with the controller; and baffle members secured to the cover inside thereof in spaced relation to the cover side walls, the baffle members including solid portions lying in interfering relation between the side wall apertures and the controller so as to prevent tools from being inserted through the apertures to adjust the setting of the controller, the baffle members not extending over the full depth of the cover side walls so as to allow air entering the apertures to flow around the baffles into air condition exchange relation with the air condition responsive controller.

2. The cover of claim 1 in which the apertured portions of the side walls of the cover are adjacent the controller and the baffle members extend between the apertured portions of the side walls and the controller.

3. The cover of claim 1 in which the portions of the cover adjacent the controller are closed and the apertured portions of the cover are positioned farther from the wall than the controller and in which the baffle members extend between the apertured portions of the cover and controller.

4. The cover of claim 1 in which the baffle members are integral with the cover.

5. The cover of claim 1 in which the baffles are in the form of two pairs of slotted baffle members designed to interlock with each other, the length of one pair of baffle members corresponding to the width of the interior of the cover and the length of the other pair of baffle members corresponding to the length of the interior of the cover so that when said baffle members are interlocked and placed within the cover, they will be retained in place in the cover.

6. The cover of claim 5 in which each slotted member has a cut-away portion which allows air entering the cover to pass into air condition exchange relationship with the controller.

7. The cover of claim 1 in which the controller is a thermostat and the cover is designed to allow air to enter the cover in heat exchange relationship with the thermostat.

8. The cover of claim 1 in which cover side wall including the top and bottom walls has apertures therethrough and in which the front wall is substantially free of apertures.

9. The cover of claim 1 in which the member secured to the wall is a plate having an opening therethrough through which the controller extends.

* * * * *